US010856646B2

(12) United States Patent
Newman et al.

(10) Patent No.: US 10,856,646 B2
(45) Date of Patent: Dec. 8, 2020

(54) ORAL-CARE IMPLEMENT HAVING COLOR-COMMUNICATIVE ELEMENT

(71) Applicant: The Procter & Gamble Company, Cincinnati, OH (US)

(72) Inventors: Matthew Lloyd Newman, Cincinnati, OH (US); Li Wen, Blue Ash, OH (US); Elizabeth Ann Brown Reno, Fairfield, OH (US); Jens Alinski, Kronberg (DE)

(73) Assignee: The Procter & Gamble Company, Cincinnati, OH (US)

( * ) Notice: Subject to any disclaimer, the term of this patent is extended or adjusted under 35 U.S.C. 154(b) by 200 days.

(21) Appl. No.: 16/133,229

(22) Filed: Sep. 17, 2018

(65) Prior Publication Data

US 2019/0014898 A1 Jan. 17, 2019

Related U.S. Application Data

(62) Division of application No. 14/331,662, filed on Jul. 15, 2014, now Pat. No. 10,098,447.

(51) Int. Cl.
*A46B 9/02* (2006.01)
*A46B 9/04* (2006.01)
(Continued)

(52) U.S. Cl.
CPC ..... *A46B 9/06* (2013.01); *A46B 9/02* (2013.01); *A46B 9/028* (2013.01); *A46B 9/04* (2013.01);
(Continued)

(58) Field of Classification Search
CPC ..... A46B 9/04; A46B 2200/1066
(Continued)

(56) References Cited

U.S. PATENT DOCUMENTS 1,773,969 A 8/1930 Dreyfus et al.
2,317,485 A 4/1943 Rider
(Continued)

FOREIGN PATENT DOCUMENTS

CN 200998006 1/2008
CN 202666559 1/2013
(Continued)

*Primary Examiner* — Randall E Chin
(74) *Attorney, Agent, or Firm* — Vladimir Vitenberg

(57) ABSTRACT

An oral-care implement comprises a mounting surface having a longitudinal axis and a transverse axis perpendicular to the longitudinal axis and a plurality of filaments outwardly extending from the mounting surface in at least one direction not parallel to either one of the longitudinal axis and the transverse axis, each filament having a free end terminating with a tip. At least some of the filaments possess at least one functional characteristic selected from the group consisting of filament's structure, composition, cross-sectional shape, tip geometry, and any combination thereof. A plurality of filament tips comprises a working surface that includes at least a first color and a second color different from the first color. The at least first color forms at least one scaled-up image graphically replicating the at least one functional characteristic, thereby visually communicating to a consumer that the oral-care implement includes filaments having certain functional characteristic(s)—and that the oral-care implement possesses superior efficacy attributable to said filaments.

18 Claims, 13 Drawing Sheets

(51) Int. Cl.
*A46B 9/06* (2006.01)
*A46D 1/00* (2006.01)

(52) U.S. Cl.
CPC ..... *A46D 1/0238* (2013.01); *A46D 1/0261* (2013.01); *A46B 2200/1066* (2013.01)

(58) Field of Classification Search
USPC .... 15/167.1, 207.2, DIG. 5, DIG. 6; D4/104
See application file for complete search history.

(56) References Cited

U.S. PATENT DOCUMENTS

| | | | |
|---|---|---|---|
| 2,876,477 | A | 3/1959 | Stewart |
| 3,032,230 | A | 5/1962 | Gerber |
| 3,072,944 | A | 1/1963 | Clayton |
| 3,214,777 | A | 11/1965 | Kutik |
| 3,238,553 | A | 3/1966 | Bailey et al. |
| 3,302,230 | A | 2/1967 | Poppelman |
| 3,344,457 | A | 10/1967 | Grobert |
| 3,613,143 | A | 10/1971 | Muhler et al. |
| 3,689,118 | A | 9/1972 | Charvat et al. |
| 3,691,585 | A | 9/1972 | Flom |
| 4,167,794 | A | 9/1979 | Pomeroy |
| 4,802,255 | A | 2/1989 | Breuer et al. |
| D301,397 | S | 9/1989 | Lacher |
| 4,958,402 | A | 9/1990 | Weihrauch |
| 5,313,909 | A | 5/1994 | Tseng et al. |
| 5,396,678 | A | 3/1995 | Bredall et al. |
| 5,701,629 | A | 12/1997 | O'Brien |
| 5,770,307 | A | 6/1998 | Rackley |
| 5,806,127 | A | 9/1998 | Samoil et al. |
| 5,906,834 | A | 5/1999 | Tseng |
| 5,985,450 | A | 11/1999 | Keller |
| 6,018,840 | A | 2/2000 | Guay et al. |
| 6,065,176 | A | 5/2000 | Watanabe et al. |
| 6,086,373 | A | 7/2000 | Schiff et al. |
| 6,138,314 | A | 10/2000 | Schiff et al. |
| 6,276,021 | B1 | 8/2001 | Hohlbein |
| 6,280,113 | B1 | 8/2001 | Gueret |
| 6,327,736 | B1 | 12/2001 | Schaefer et al. |
| 6,352,772 | B1 | 3/2002 | Keller |
| 6,390,708 | B1 | 5/2002 | Gueret |
| 6,669,389 | B2 | 12/2003 | Gueret |
| RE38,646 | E | 11/2004 | Gueret |
| 6,871,373 | B2 | 3/2005 | Driesen et al. |
| 7,014,800 | B2 | 3/2006 | Weihrauch |
| 7,644,466 | B2 | 1/2010 | Weihrauch et al. |
| 8,297,710 | B2 | 10/2012 | Sakurai et al. |
| 8,453,288 | B2 | 6/2013 | Driesen et al. |
| 8,726,448 | B2 | 5/2014 | Kato et al. |
| 9,445,660 | B2 | 9/2016 | Mintel et al. |
| 2002/0164192 | A1 | 11/2002 | Gueret |
| 2003/0044604 | A1 | 3/2003 | Weihrauch |
| 2003/0088935 | A1 | 5/2003 | Favagrossa |
| 2007/0289078 | A1 | 12/2007 | Driesen et al. |
| 2008/0245385 | A1 | 10/2008 | Schrepf |
| 2009/0142125 | A1 | 6/2009 | Henrikson |
| 2010/0306944 | A1 | 12/2010 | Herzog |
| 2011/0030160 | A1* | 2/2011 | Knutzen ..... A46B 9/04 15/167.1 |
| 2012/0246857 | A1 | 10/2012 | Kato et al. |
| 2012/0301210 | A1 | 11/2012 | Sturgis et al. |
| 2013/0139339 | A1* | 6/2013 | Hess ..... A61C 17/3445 15/167.1 |
| 2013/0318732 | A1 | 12/2013 | Mintel |
| 2015/0150367 | A1 | 6/2015 | Moskovich |
| 2015/0257520 | A1 | 9/2015 | Storkel et al. |
| 2015/0359326 | A1 | 12/2015 | Chan et al. |
| 2015/0361590 | A1 | 12/2015 | Chan et al. |
| 2016/0015163 | A1 | 1/2016 | Newman et al. |
| 2019/0104839 | A1 | 4/2019 | Mark |
| 2019/0104840 | A1 | 4/2019 | Mark |
| 2019/0104841 | A1 | 4/2019 | Alinski |

FOREIGN PATENT DOCUMENTS

| | | |
|---|---|---|
| CN | 202941618 | 5/2013 |
| DE | 102006035156 | 1/2008 |
| EP | 0663162 | 7/1995 |
| EP | 2918191 | 9/2015 |
| JP | H06217830 | 8/1994 |
| JP | H06233709 | 8/1994 |
| JP | 2001169829 | 6/2001 |
| JP | 2002010831 | 1/2002 |
| JP | 2005185399 | 7/2005 |
| JP | 2005253713 | 9/2005 |
| JP | 2006255068 | 9/2006 |
| JP | 2007068954 | 3/2007 |
| JP | 2007185464 | 7/2007 |
| JP | 2007229317 | 9/2007 |
| JP | 2007283443 | 11/2007 |
| JP | 2007283444 | 11/2007 |
| JP | 2008023205 | 2/2008 |
| JP | 2008212510 | 9/2008 |
| JP | 2009148507 | 9/2009 |
| JP | 2009219520 | 10/2009 |
| JP | 2011030891 | 2/2011 |
| JP | 2012106308 | 6/2012 |
| JP | 3186567 U | 10/2013 |
| KR | 200183557 | 5/2000 |
| KR | 20080011846 | 2/2008 |
| WO | WO0164072 A1 | 9/2001 |
| WO | WO200228222 | 4/2002 |
| WO | WO2012096700 | 7/2012 |
| WO | WO2012096701 | 7/2012 |

* cited by examiner

ORAL-CARE IMPLEMENT HAVING COLOR-COMMUNICATIVE ELEMENT

FIELD OF THE INVENTION

The present disclosure is concerned with an oral-care implement, and in particular with an oral-care implement that communicates to a consumer, by coordinated color pattern(s), information pertaining to functional characteristics of its cleaning elements.

BACKGROUND OF THE INVENTION

Oral-care implements, such as manual toothbrushes and refills for power/electrical toothbrushes, comprising a plurality of cleaning filaments, or bristles, are well known in the art. Typically, the filaments are arranged in tufts and are attached to a mounting surface of a portion of the oral-care implement's plastic body (also known as a "head") intended for insertion into a user's mouth. Typically, the tuft has an outer lateral surface having, overall, either a substantially cylindrical shape or a substantially rectangular shape. The filaments' free ends can be end-rounded or otherwise treated to eliminate sharp edges at the filaments' tips and hence their potential harmful effect on gums during brushing.

The oral-care implement's working surface, comprising a "surface" formed by the combined field of the filaments' tips, can be profiled to comprise any suitable shape, including, e.g. and without limitation, concave, convex, wavy, and the like shapes. A grip handle may be either removably attached to the head or made integral with the head. The former configuration is typical for a power brush, while the latter is for a manual brush.

Conventional cylindrical filaments have been used in a variety of oral-care implements. While some toothbrushes comprising cylindrical filaments can adequately clean the outer buccal face of teeth, they may have certain limitations with respect to providing effective removal of plaque and debris from the gingival margins, interproximal areas, lingual surfaces, and other hard-to-reach areas of the mouth. Smooth cylindrical surfaces and/or smooth tips of the conventional filaments are not effective for picking up and utilizing the particles in dentifrice. Nor can they have effective abrasion efficiency against dental plaque.

Therefore, toothbrush manufactures, in addition to conventional cylindrical filaments, have begun using filaments having a variety of shapes, including cross-sectional shapes, and a variety of surfaces, including textured surfaces. Non-cylindrical filaments and/or filaments having textured or roughened surface may provide a better plaque-removal and/or stain-removal efficacy. Non-limiting examples of non-cylindrical filaments include filaments having spiral or helical shapes, filaments having elliptical cross-sectional shapes, filaments having rectangular cross-sectional shapes, filaments having triangular cross-sectional shapes, filaments comprising X-shaped or cross-shaped cross-sections, filaments comprising star-shaped cross-section, filaments comprising bi-lobal and multi-lobal cross-sections, and the like. Oral-care implements having composite filaments, i.e., filaments comprising more than one material, are also known in the art.

Multiple attempts to design more effective filaments have been made. For example, U.S. Pat. No. 6,138,314 is directed to a toothbrush having an improved cleaning and abrasion efficiency. The bristles in that toothbrush contain longitudinal channels having a depth sufficient to entrap a quantity of abrasive particles such that during brushing with toothpaste, contact between the channel-entrapped abrasive particles and the surfaces of the teeth is improved. U.S. Pat. No. 3,613,143 is directed to a toothbrushes having abrasive impregnated bristles of two cross-section designs, i.e., to generally circular and polygon with the latter described as having longitudinal groove arrangements. U.S. Pat. No. 4,167,794 is directed to rounded bristles having shovel-like distal ends for more effective plaque removal. U.S. Pat. No. 4,958,402 is directed to fiber-flocking synthetic bristles that can retain and more effectively distributing a substance on the surface to be treated. U.S. Pat. No. 3,032,230 is directed to bristles having a polygon cross-section having at least two acute angles that impart a "scraping" effect on the teeth. U.S. Pat. No. 3,214,777 is directed to bristles having a rectangular cross-sectional area.

A variety of shapes of filaments and/or filament surfaces used in today's advanced oral-care implements creates a need to easily communicate, to a consumer, specific information pertaining to a particular type or types of filaments used in a given oral-care implement—and thus advantages provided thereby. A typical toothbrush can have from about 400 to about 1000 cleaning filaments. For example, in a basic brush having 36 tuft holes and an average number of filaments 24, there are 864 filaments altogether, tightly packed in tufts. If the filaments are stapled, i.e., bent in half, the number of their free ends is 1728. A typical cleaning filament's equivalent diameter, or an average cross-sectional dimension, is from about 0.1 mm to about 0.21 mm. Such a small size of an individual filament makes it virtually impossible for a naked human eye to see, much less assess, the individual filament's geometry, including the shape of the individual filament's tip or cross-section.

A commonly assigned application CM04051FQ, EP14158836.8, which is incorporated herein by reference, is directed to providing an oral-care implement's head comprising a plurality of filaments arranged in a tuft having a scaled-up shape with respect to the shape of the cross-sectional area of the individual filament.

In addition, information pertaining to functional characteristics of the filaments, including their geometry and cross-sectional shapes, can be communicated by using color forming certain shapes on the working surface of the oral-care implement. Likewise, information regarding the superior efficacy of the oral-care product, having those filaments, can be communicated to the consumer. The present disclosure is directed to accomplishing these tasks.

SUMMARY OF THE INVENTION

An oral-care implement comprises a mounting surface having a longitudinal axis and a transverse axis perpendicular to the longitudinal axis and a plurality of filaments outwardly extending from the mounting surface in at least one direction not parallel to either one of the longitudinal axis and the transverse axis, each filament having a free end terminating with a tip. At least some of the filaments possess at least one functional characteristic selected from the group consisting of filament's structure, composition, cross-sectional shape, tip geometry, and any combination thereof. A plurality of filament tips comprises a working surface that includes at least a first color and a second color different from the first color. The at least first forms at least one scaled-up image graphically replicating the at least one functional characteristic, thereby visually communicating to a consumer that the oral-care implement includes filaments having certain functional characteristic(s).

The at least one functional characteristic may include the filament's shape, such as, e.g., a rectangular or other non-circular shape of the filament's cross-section perpendicular to the filament's longitudinal axis. In that instance, the at least one image comprises a rectangular having the first color and a background having a second color. If the filament has a cylindrical shape, and therefore a circular cross-section, the at least one image comprises a circle having the first color and a background having a second color.

In another exemplary embodiment, the at least one functional characteristic comprises a rectangular cross-section of a filament, and the at least one image comprises a rectangular having the first color and a background having the second color.

In still another exemplary embodiment, the at least one functional characteristic comprises a triangular cross-section of a filament, and the at least one image comprises a triangular having the first color and a background having the second color.

In yet another exemplary embodiment, the at least one functional characteristic comprises an elliptical cross-section of a filament, and the at least one image comprises an ellipse having the first color and a background having the second color.

In one particular exemplary embodiment, the at least one functional characteristic comprises an X-shaped, or cross-shaped, cross-section of a filament, and the at least one image comprises an X-shaped, or cross-shaped, area having the first color and a background having the second color.

In a further exemplary embodiment, the at least one functional characteristic comprises a star-shaped cross-section of a filament, and the at least one image comprises a star-shaped area having the first color and a background having the second color.

In an exemplary embodiment in which the at least one functional characteristic comprises a multi-lobal cross-section of a filament, the at least one image comprises a multi-lobal area having the first color and a background having the second color.

In another exemplary embodiment of the oral-care implement, the at least one functional characteristic comprises a tapered tip of a filament, and the at least one image comprises a triangle having the first color and a background having the second color, wherein the triangle proportionally approximates relative dimensions of the tapered tip.

The at least one functional characteristic may comprise a filament's tip surface that includes one or more islands, formed by one or more protrusions or one or more craters. Then, the at least one image comprises one or more areas having the first color and a background having the second color.

In an exemplary embodiment in which the at least one functional characteristic comprises a multi-component composition of a filament, the at least one image comprises at least one area having the first color circumferentially encompassed by at least one ring having the second color. In a further embodiment, the working surface may optionally include a third color, different from the first color and the second color, the third color forming a background.

In another exemplary embodiment, the oral-care implement may comprise a first plurality of filaments and a second plurality of filaments, the first plurality of filaments having a first functional characteristic, and the second plurality of filaments having a second functional characteristic, wherein the first functional characteristic is different from the second functional characteristic. In a further embodiment, the first plurality of filaments may comprise the first color and the second plurality of filaments may comprise the second color.

In an exemplary embodiment of the oral-care implement comprising three pluralities of filaments: a first plurality of filaments, a second plurality of filaments, and a third plurality of filaments. The first plurality of filaments may have a first functional characteristic, the second plurality of filaments may have a second functional characteristic, and the third plurality of filaments may have a third functional characteristic. The first functional characteristic and/or the second functional characteristic and/or the third functional characteristic can be selected from the group consisting of filament's structure, composition, cross-sectional shape, tip geometry, and any combination thereof.

In one embodiment of the oral-care implement of the disclosure, the at least one functional characteristic may comprise a roughened area of a portion of the filament's surface, such as, e.g., the filament's free end and an area adjacent thereto. Then, the at least one image may comprises a graphic outline including the first color and comprising a broken line, selected from the group consisting of a dotted line, dashed line, and any combination thereof.

In a further embodiment, some of the filaments can be arranged in one or more tufts having a shape comprising a scaled-up image graphically replicating a shape of the cross-section of the filaments forming this of these tuft or tufts.

Embodiments are contemplated in which the first color comprises a color-changing material or color-fading material. Such a material may cause the first color to gradually change or fade to eventually match the second color after a predetermined period of use of the oral-care implement.

In one particular embodiment, the first color may at least partially cover the second color, and the first color is structured to slowly worn away during the use of the oral-care implement to indicate an extent to which the filaments are worn. When the first color is substantially worn away after a predetermined period of use of the oral-care implement, the scaled-up image graphically replicating the functional characteristic is noticeably altered—and may even be largely destroyed. This can effectively signal to the user that the filaments no longer possess the desired functional characteristic(s) for effectively performing their intended function.

The invention is also directed to a manual toothbrush and/or a refill for an electrical toothbrush comprising the oral-care implement as described herein.

BRIEF DESCRIPTION OF THE DRAWINGS

The embodiments set forth in the drawings are illustrative and exemplary in nature—and neither are intended to limit the subject matter defined by the claims nor should be interpreted to exclude embodiments not specifically illustrated by the drawings. The detailed description of the illustrative embodiments can be best understood when read in conjunction with the drawings, where like structures are indicated with like reference numerals.

DETAILED DESCRIPTION OF THE INVENTION

Figure 1:
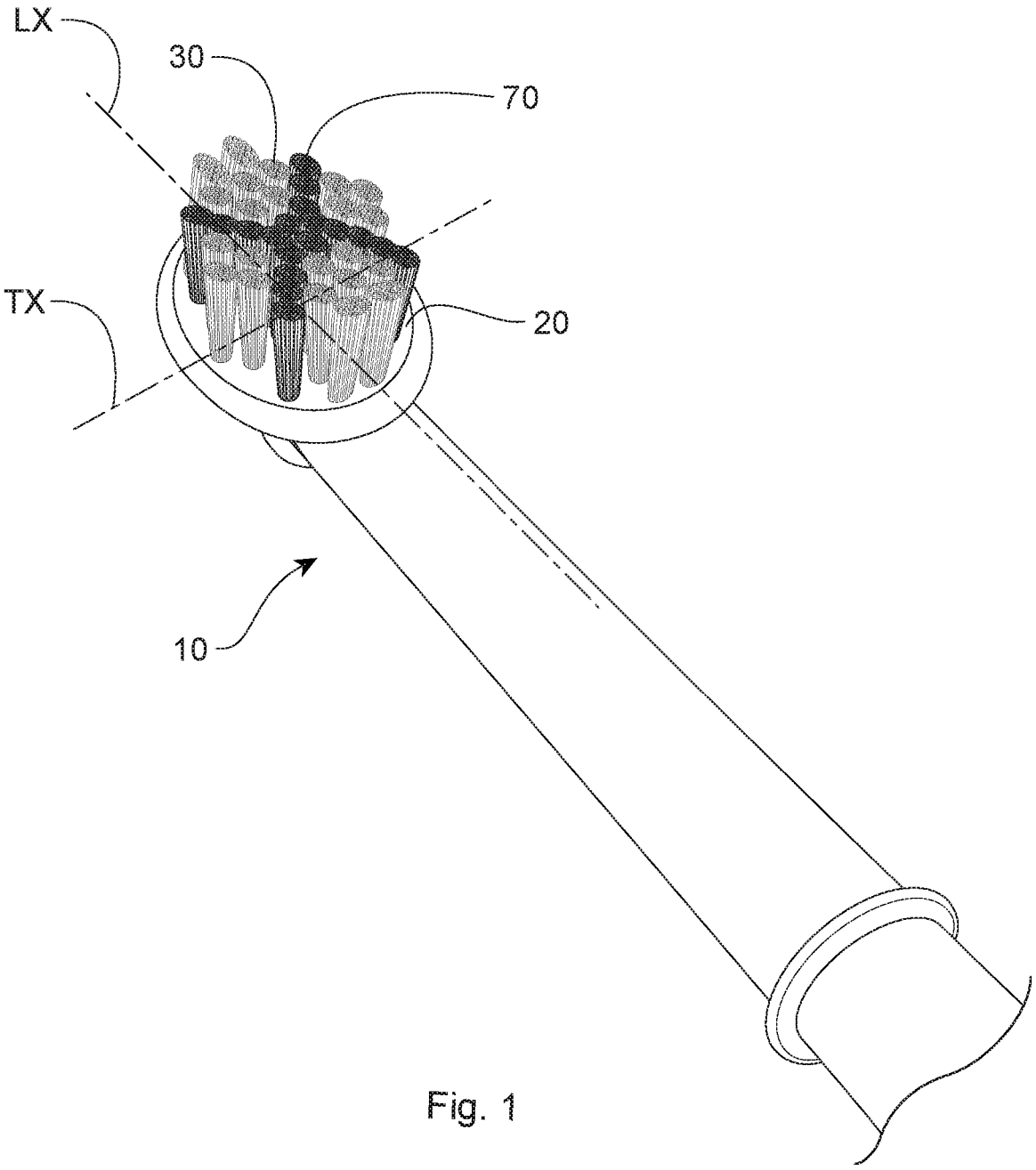
FIG. 1 schematically shows a perspective view of an exemplary embodiment of an oral-care implement of the disclosure, comprising a replaceable refill for an electric toothbrush.

As used herein, the following terms have the following meanings.

"Color" includes, all spectral qualities such as red, orange, yellow, green, cyan, blue, violet, black, white, brown, gray, and so on. In addition, the term includes any aspect of the appearance of any components of an oral-care implement, such as, e.g., filaments, that may be described in terms of relative intensity, brightness, hue, lightness, saturation, as well as any specific combination of the above—as long as one color (e.g., a "first color") is distinguishable from another color (i.e., a "second color") or other colors in visible light. For example, a group of filaments having a dark-blue color and a group of filaments having a light-blue color are two groups of filaments having different colors for the purposes of this disclosure.

"Cross-section" of a filament is a filament's surface or shape that is or would be exposed by making a straight cut through the filament substantially perpendicularly to the filament's longitudinal axis. "Longitudinal cross-section" is a filament's surface or shape that is or would be exposed by making a straight cut through the filament substantially parallel to the filament's longitudinal axis.

"Filament's structure" includes, among other things, a roughened or textured surface of a filament. For example, a portion of the filament's surface can be roughened or otherwise textured to include surface irregularities that would increase the efficacy of stain and plaque removal from the teeth surface. Such a roughened/textured portion may include, e.g., the entire surface of the filament or only the filament's free end and an area adjacent thereto. The term also includes a side-view profile of a filament or the longitudinal cross-section of a filament. The term may also refer to such qualities of the filament as having an antimicrobial agent.

"Image" and "scaled-up image" refer to a visual representation of an object, such as, e.g., a shape of the filament's cross-section or a shape of the filament's free end, which visual representation can be easily observed by a human's naked eye in visible light. In the context of a filament, and particularly filament's cross-section, an "image" or a "scaled-up image" may beneficially have approximate likeness or resemblance to the filament's cross-section represented by the scaled-up image. The scaled-up image may, in some instances retain the essential proportions of the shape being emulated by that scaled-up image. One example of this comprises the scaled-up image of a cylindrical filament, having a round cross-section. In other instances, only a principal configuration need to be emulated by the scaled-up image, and the relative proportions of the corresponding elements do not need to be identical. If, for example, an X-shaped cross-section of a filament includes 90-degree angles formed between two mutually intersecting elements of the cross-section as viewed in plan view, the scaled-up image of such an X-shaped cross-section may have elements intersecting at angles from about 30 degrees to about 60 degrees—as long as the principal shape of the filament's X-shaped cross-section is effectively communicated to a consumer through the scaled-up image.

The terms "image" and "scaled-up image" also include visual representations made in accordance with the Gestault principles of perception, relying on similarity, continuation, closure, proximity, symmetry, common-region, focal-point, and related concepts. People tend to see the whole before they see the individual parts that make up that whole. Because a human eye differentiates an object from a surrounding area, people can perceive a shape/form/silhouette/outline as an image of a figure, while the surrounding area is perceived as a background. People also perceive similarly looking objects as a group of related objects, a pattern, or a single unit. When an object is incomplete but enough of the object's shape is indicated, people perceive the whole object by filling in the missing information. For example, a broken line comprising two, three, of four identically curved lines disposed in a shape of a circle will impart, as a whole, the perception of a complete circle even though the object itself is incomplete. Likewise, four straight lines disposed in a shape of a square but not touching one another at "corners" will be perceived as a square even though none of the lines is connected to any of the other line.

"Plan view" of an oral-care implement refers to an appearance of the oral-care implement as seen from above, wherein the observer's line of vision is substantially perpendicular to a fiber-mounting surface of the implement.

"Polygon" includes geometric figures comprising triangles, rectangles, rhombuses, trapezoids, squares, tetragons, and the like, as well as regular and irregular polygons having five, six, seven, eight, and more sides.

Figure 2:
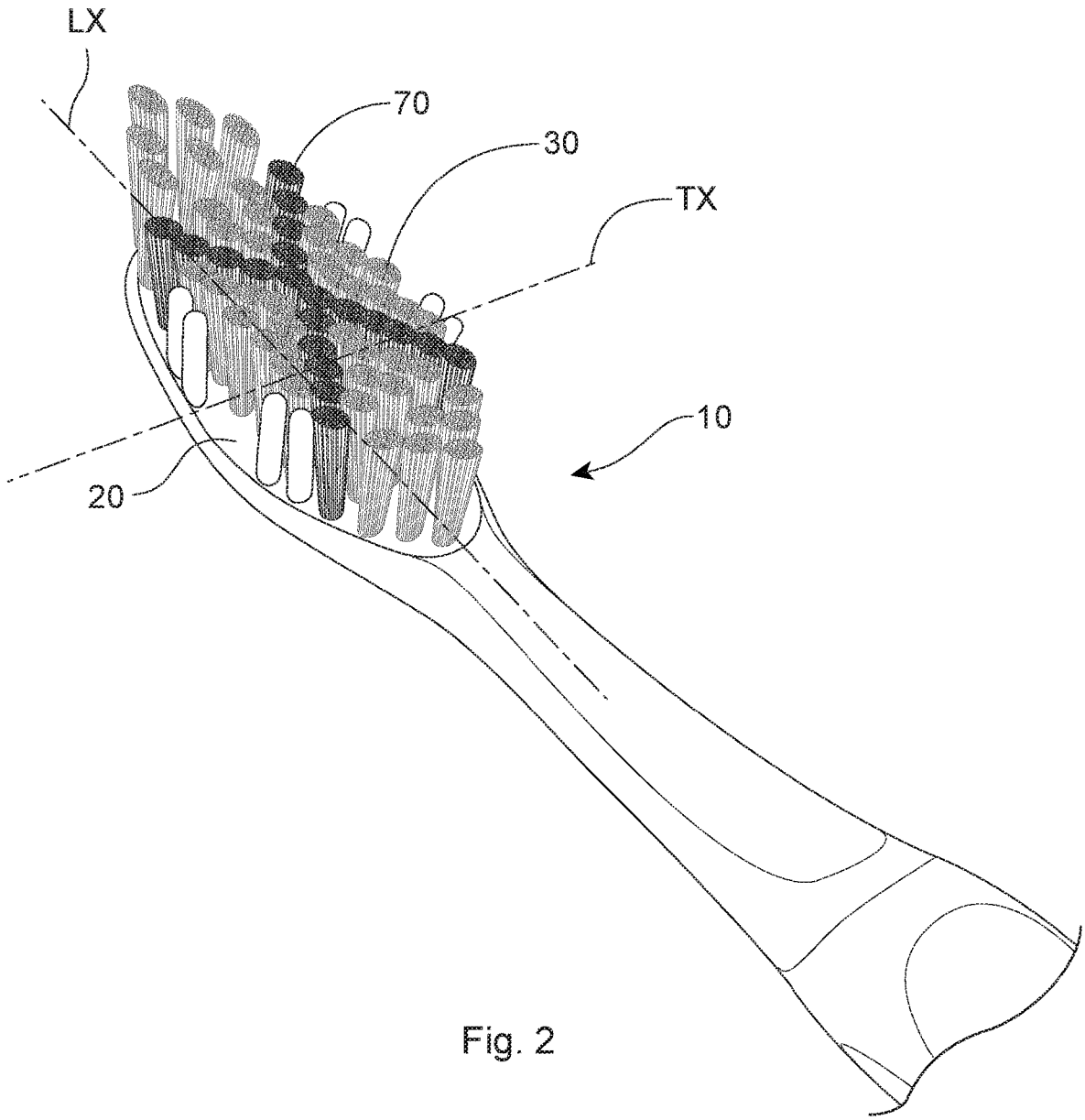
FIG. 2 schematically shows a perspective view of an exemplary embodiment of an oral-care implement of the disclosure, comprising a manual toothbrush.

This invention is particularly beneficial for the purposes of communicating functional characteristics of filaments having cross-sections comprising non-circular shapes. Two exemplary embodiments of devices that include an oral-care implement 10 of the disclosure are schematically shown in FIGS. 1 and 2. FIG. 1 illustrates a refill for a power/electric toothbrush; and FIG. 2 illustrates a manual toothbrush. Each of the exemplary embodiments of the oral-care implement illustrated and described herein comprises filaments that possess at least one functional characteristic selected from the group consisting of filament's structure, filament's composition, filament's cross-sectional shape, filament's tip geometry, and any combination thereof. In FIGS. 1 and 2, such functional characteristic is filament's specific cross-sectional shape in the form of "X" or "cross."

The oral care-implement 10 comprises a mounting surface 20 having a longitudinal axis LX and a transverse axis TX perpendicular to the longitudinal axis LX. A plurality of filaments 30 outwardly extends from the mounting surface 20 in at least one direction not parallel to either one of the longitudinal axis LX and the transverse axis TX. One skilled in the art will readily understand that the filaments 30 may have different orientations relative to the mounting surface 20 and to one another. Thus, the individual filaments 30, or tufts of the filaments 30, may have differential angles relative to the mounting surface 20—and consequently may extend therefrom in more than one direction not parallel to either of the axes LX, TX.

Figure 3:
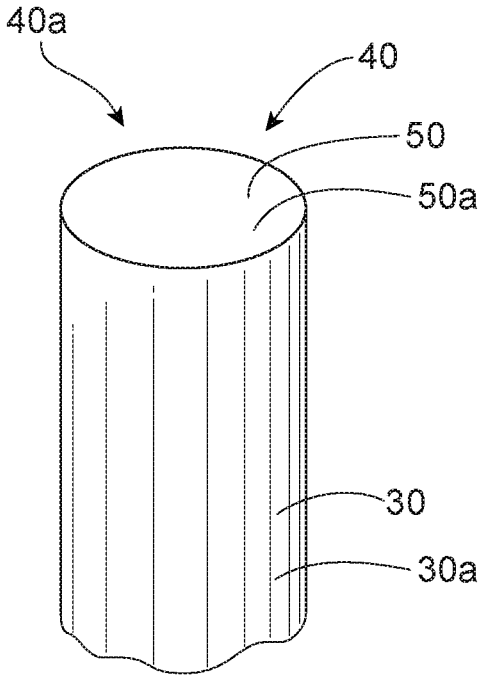
FIG. 3 schematically shows an enlarged perspective view of a conventional cylindrical filament.
Figure 4:
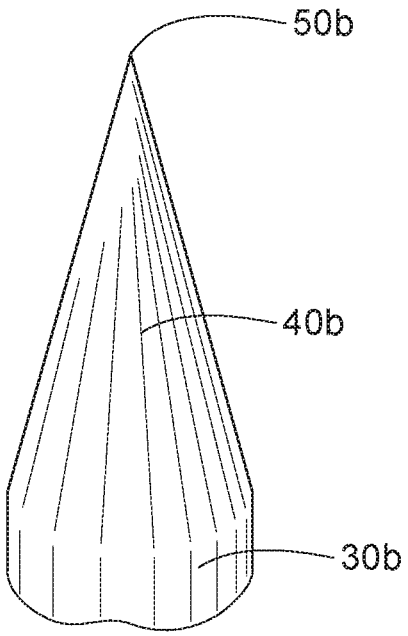
FIG. 4 schematically shows an enlarged perspective view of an exemplary embodiment of a filament having a trimmed free end having a generally conical shape.
Figure 5:
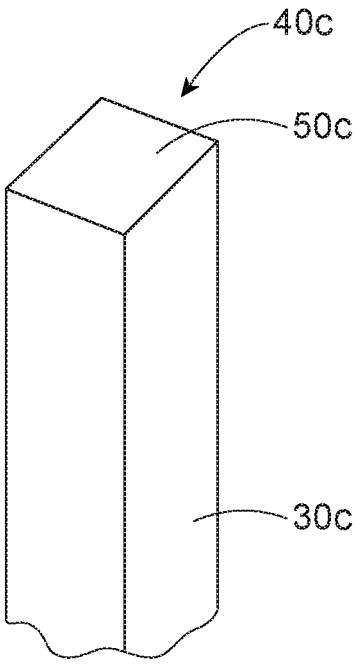
FIG. 5 schematically shows an enlarged perspective view of an exemplary filament having a generally rectangular cross-section.
Figure 6:
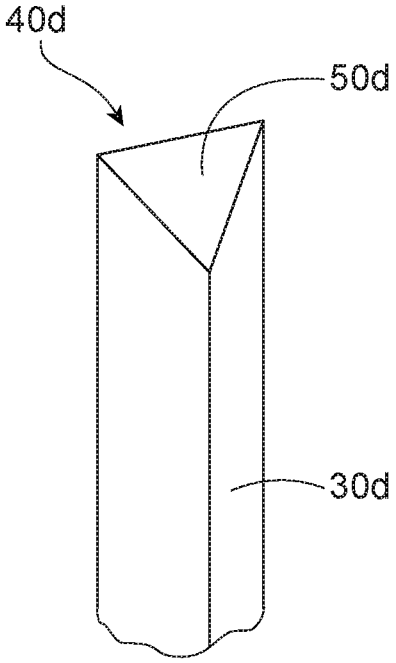
FIG. 6 schematically shows an enlarged perspective view of an exemplary filament having a generally triangular cross-section.

Each of the filaments 30 has a free end 40 terminating with a tip 50, FIG. 3. FIGS. 3-13 illustrate several embodiments of filaments having different exemplary cross-sections. In FIG. 3, the cylindrical filament 30*a* has a generally circular cross-section. The filament 30*a* has a free end 40*a* terminating with a tip 50*a*. In FIG. 4, a filament 30*b* is profiled to have a free end 40*b* terminating with a tip 50*b*. In FIG. 5, a generally prismatic filament 30*c* has a generally rectangular cross-section. One skilled in the art will understand that embodiments are contemplated in which the prismatic filament 30*c* may have any suitable polygonal cross-section, either regular or irregular, and comprising, e.g., three, five, six, seven, and so on, sides. Thus, in FIG. 6, a filament 30*d* has a generally triangular cross-section and a free end 40*d* terminating with a tip 50*d*.

Figure 7:
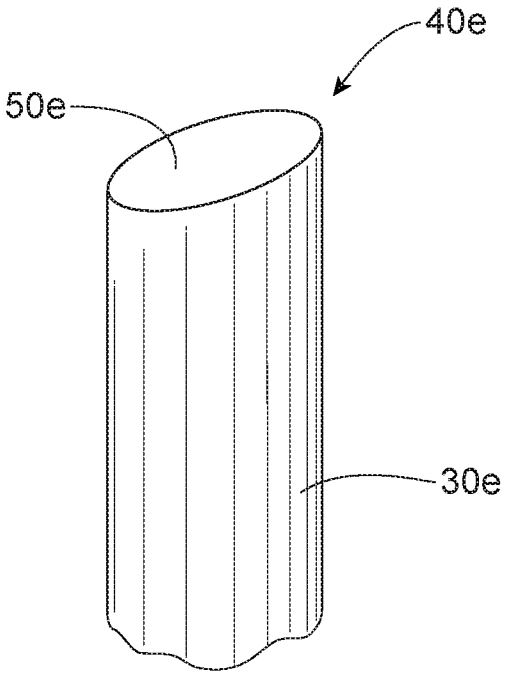
FIG. 7 schematically shows an enlarged perspective view of an exemplary filament having a generally elliptical, or oval, cross-section.
Figure 8:
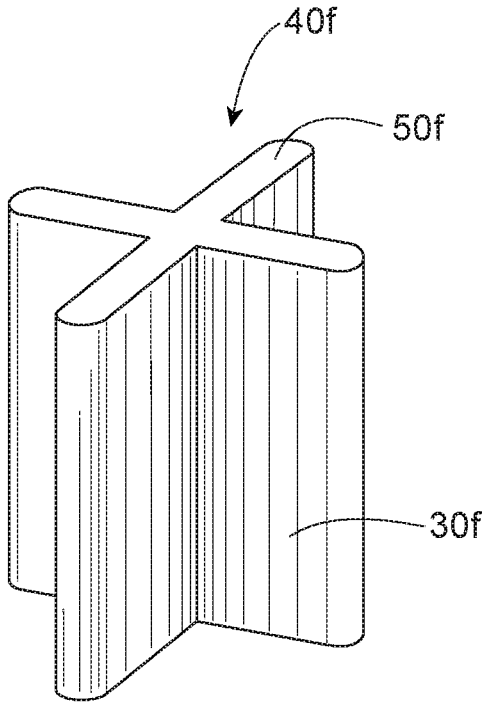
FIG. 8 schematically shows an enlarged perspective view of an exemplary filament having an X-shaped, or cross-shaped, cross-section.
Figure 9:
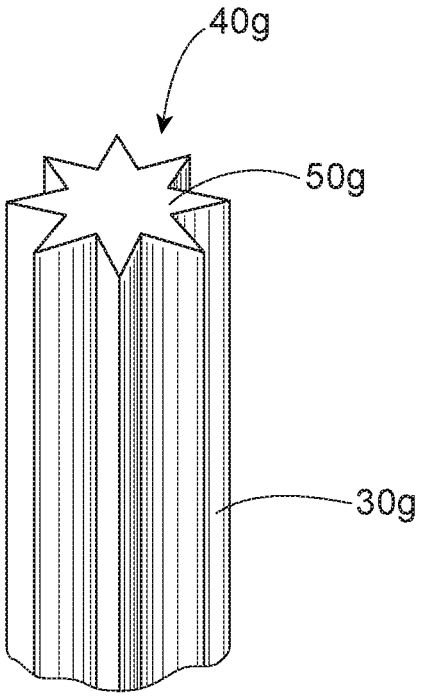
FIG. 9 schematically shows an enlarged perspective view of an exemplary filament having a star-shaped cross-section.
Figure 10:
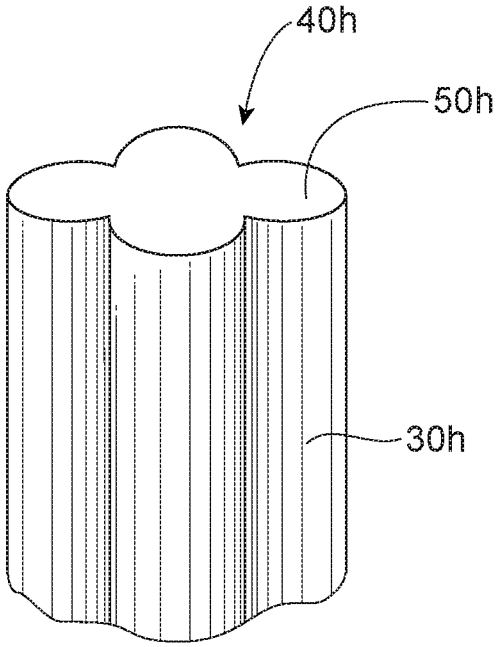
FIG. 10 schematically shows an enlarged perspective view of an exemplary filament having a multi-lobal cross-section.

In an embodiment of FIG. 7, a filament 30*e* has a generally elliptical, or oval, cross-section and a free end 40*e* terminating with a tip 50*e*. In an embodiment of FIG. 8, a filament 30*f* has a generally X-shaped, or cross-shaped cross-section and a free end 40*f* terminating with a tip 50*f*. In an embodiment of FIG. 9, a filament 30*g* has a body comprising longitudinal grooves and a star-shaped cross-section. The filament 30*g* has a free end 40*g* terminating with a tip 50*g*. In an embodiment of FIG. 10, a filament 30*h* has a generally multi-lobal cross-section and a free end 40*h* terminating with a tip 50*h*. While the filament shown in FIG. 10 has four lobes, other embodiments, comprising three, five, six, and so one, lobes are also contemplated.

Figure 11:
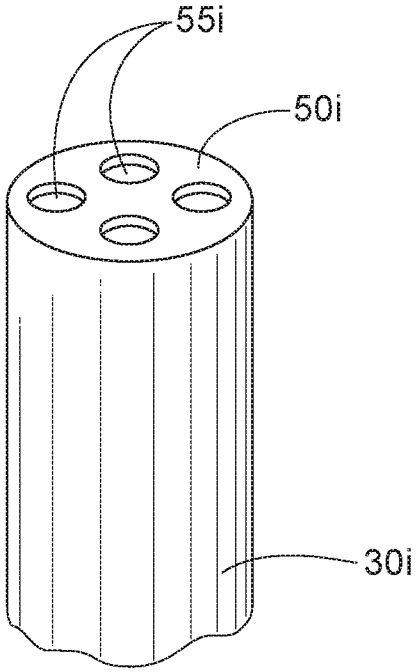
FIG. 11 schematically shows an enlarged perspective view of an exemplary filament having a tip surface including a plurality of islands comprising discrete craters, or recesses.
Figure 12:
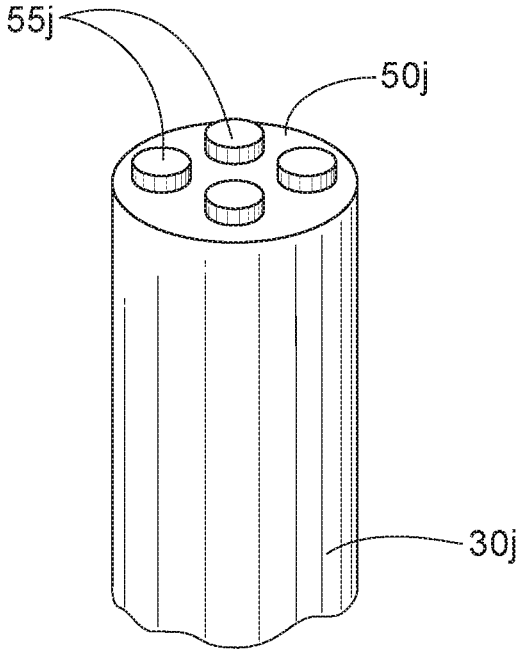
FIG. 12 schematically shows an enlarged perspective view of an exemplary filament having a tip surface including a plurality of islands comprising discrete projections.

In an embodiment of FIG. 11, a filament 30*i* has a tip 50*i* that includes a tip surface having a plurality of islands comprising discrete craters, or recesses, 55*i*. In an embodiment of FIG. 12, a filament 30*j* has a tip 50*j* that includes a tip surface having a plurality of islands comprising discrete projections 57*j*. While each of the exemplary FIGS. 11 and 12 shows four substantially cylindrical islands, it should be understood that the number of the islands and their shape are not limited to those shown. For example, commonly assigned application Ser. No. 14/301,667 and application Ser. No. 14/301,716 disclose various embodiments of filaments comprising craters; the disclosures of these applications are incorporated herein by reference.

Figure 13:
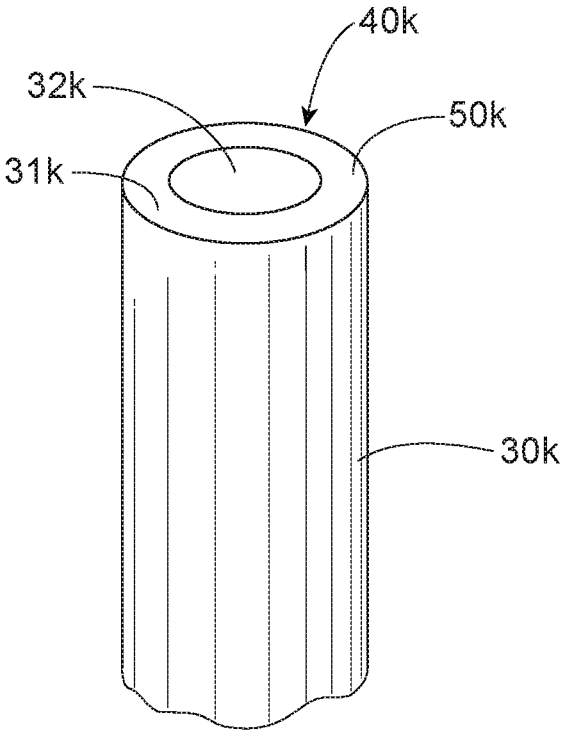
FIG. 13 schematically shows an enlarged perspective view of an exemplary composite, multi-component filament comprising a first material forming a core and a second material forming a sheath.

In an embodiment of FIG. 13, a composite, bi-component filament 30*k* comprises a first material 31*k* forming a core and a second material 32*k* forming a sheath. Other embodiments of a multi-component filament, comprising, e.g., three or four different materials are also contemplated by the present disclosure. Bi-component or multi-component filaments can be produced by any suitable method, e.g., co-extrusion, followed by drawing. Extrusion may include multiple spinning techniques, such as, e.g., wet spinning, dry spinning, melt spinning, gel spinning, electro-spinning, jet-wet spinning, and the like. Another technique for the production of composite filaments is commonly known as "pultrusion."

Figure 14:
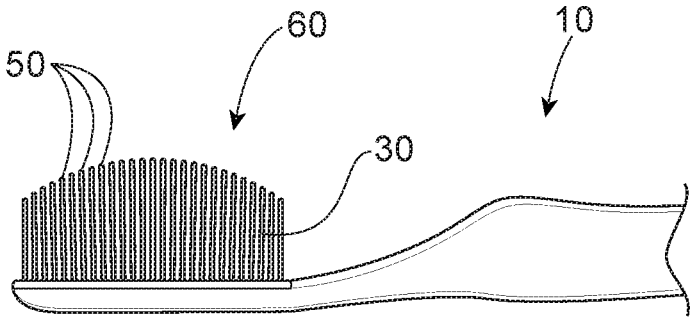
FIG. 14 schematically shows a side view of an exemplary embodiment of an oral-care implement having a working surface that comprises a convex portion.
Figure 15:
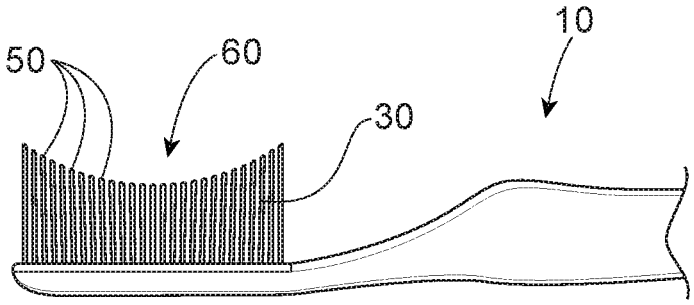
FIG. 15 schematically shows a side view of an exemplary embodiment of an oral-care implement having a working surface that comprises a concave portion.
Figure 16:
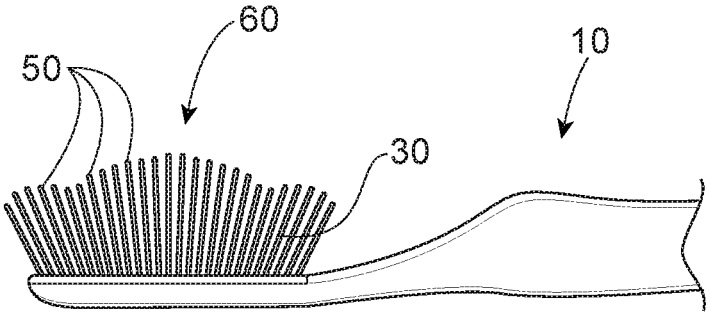
FIG. 16 schematically shows a side view of an exemplary embodiment of an oral-care implement having a working surface that comprises concave portions and convex portions.

As best shown in FIGS. 1 and 2, a plurality of tips 50 of the filaments 30 extending from the mounting surface 20 comprises a working surface 60. In a side view, the working surface 60 can have any suitable configuration, as is known in the art. For example, the working surface 60 can include a convex portion (FIG. 14) and/or a concave portion (FIG. 15), or any combination thereof (FIG. 16). The working surface can also be formed by filaments and/or filament tufts having differential lengths relative to one another. In a plan view, the working surface 60 has a perimeter outlined by peripheral tips.

The working surface 60 includes at least a first color 61 and a second color 62 different from the first color. Depending on the application, the first and second colors 61, 62 may be chosen to comprise contrasting colors, such as, e.g., black and white, or red and green. The first and second colors 61, 62 may also be chosen to comprise somewhat related but at the same time definitely distinguishable colors—particularly when these colors are mutually juxtaposed on a product and the difference therebetween can be easily observed. Non-limiting examples of the latter include a first color 61 comprising light-blue color and a second color 62 comprising dark-blue color, or a first color 61 comprising red (warm) violet/purple color and a second color 62 comprising blue (cool) violet/purple color.

Any suitable method known in the art can be used to produce the plurality of filaments having the at least first and second colors 61, 62. For example, the filaments can be made from a material having a desired color. Additionally or alternatively, the filaments can be colored during an extrusion process. For example, colored filaments can be made by first mixing colorant into base resin, melting the mixture, and then extruding the molten mixture through the capillary die. The U.S. Pat. No. 4,802,255, the disclosure of which is incorporated herein by reference, discloses a ring dyeing process wherein a filament is contacted with a dye for a time sufficient to at least color surface and preferably to also penetrate into a portion of cross-sectional area to provide a degree of dye penetration.

The filaments can be colored in their entirety—or, alternatively, only free ends and, optionally, surfaces areas adjacent thereto can have a requisite color. The tips of the filaments can be dyed as a post-process, after the filaments have been cut, stapled into a brush head, and trimmed and/or end-rounded. The filament tip can then be soaked into a liquid dye for a specific period of time. To selectively dye a specific area of the filaments on a brush, one can use, e.g., a cover with a cut-out hole of the shape of the area that needs to be dyed. When the cover shields a top portion of the brush head, only the filament tips exposed through the cut-out hole on the brush head (and having length of approximately 1 mm-2 mm) can be dyed, by e.g., being dipped into a dye for a period of time.

Another example includes coextruding a filament having two materials and two different colorants such as, e.g., the one disclosed in the U.S. Pat. No. 5,906,834, the disclosure of which is incorporated herein by reference, and which is directed to sustained-release matrices for dental application including either an anti-microbial agent or a colorant that is released from the matrix when the matrix contacts water. The preferred matrices include a water-soluble polymer and a water-insoluble support resin.

In a further example, free ends of a plurality of bi-component or multi-component filaments, each comprising at least one core having a first color and a sheath having a second color, can be treated to remove, mechanically or chemically, the second material from the filaments' free ends (e.g., from about 1 mm to about 2 mm). This would cause the core material, having the first color, being exposed—and will result in the filament with a tip or tips (and areas adjacent thereto) having the first color and the rest of the filament's body having the second color.

The first color forms at least one scaled-up image 70 (FIGS. 1, 2) graphically replicating the at least one functional characteristic of the filaments 30, described herein above. In some embodiments, a scaled-up image 70 can be formed by the first and second colors 61, 62 in combination. For example, the filaments having the second color 62 may be arranged so that the second color 62 comprises a suitable background for the first color 61. The scaled-up image 70 visually communicates to a consumer that the oral-care implement 10 includes filaments 30 having a certain functional characteristic or certain functional characteristics.

Each of the first color 61 and the second color 62, and a color of the mounting surface 20 can be coordinated as desired. Such an arrangement may be particularly beneficial in embodiments where the mounting surface is largely visible in a plan view, through the plurality of filaments 30. For example, one of the first and second colors 61, 62 can be selected to complement, or coincide with, the color of the mounting surface 20, while the other one of the first and second colors 61, 62 can be selected to contrast the color of the mounting surface 20.

Figure 17:
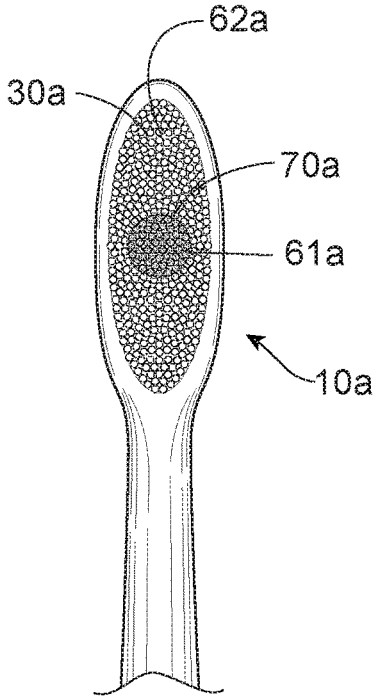
FIG. 17 schematically shows a plan view of an exemplary embodiment of an oral-care implement having a scaled-up image comprising a circle and representing a cylindrical shape of a plurality of filaments used in the oral-care filament.

FIGS. 17-27 illustrate several exemplary, non-limiting embodiments of the oral-care implement 10 comprising various patterns of the image 70, communicating to a consumer a corresponding functional characteristic of the filaments used in the oral-care implement. For example, in FIG. 17, schematically showing a fragment of a manual toothbrush comprising an oral-care implement 10*a*, the functional characteristic of at least some of filaments 30*a* comprises a cylindrical shape of an individual filament, and a scaled-up image 70*a* comprises a circle having a first color 61*a* and a background having a second color 62*a* different from the first color 61*a*.

Figure 18:
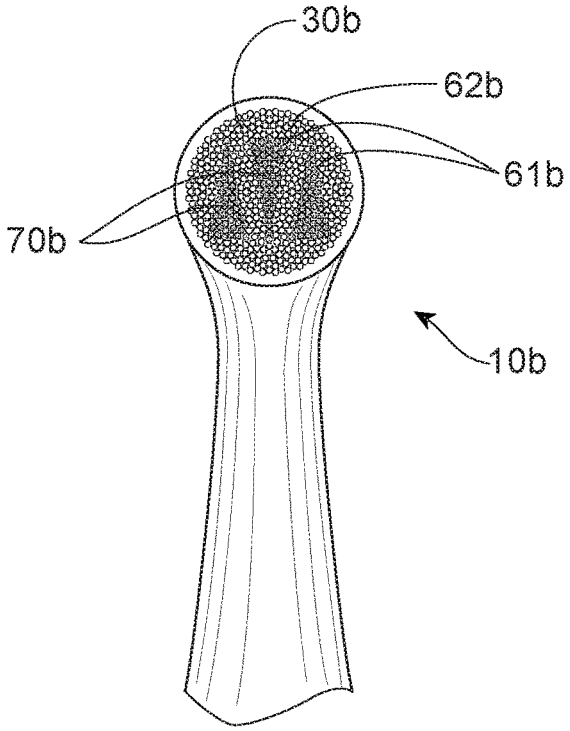
FIG. 18 schematically shows a plan view of an exemplary embodiment of an oral-care implement having a scaled-up image comprising a plurality of triangles and representing a functional characteristic of a plurality of filaments having trimmed free ends of a generally conical shape.

In FIG. 18, schematically showing a fragment of a refill for an electric toothbrush comprising an oral-care implement 10*b*, the functional characteristic of at least some of the filaments 30*b* comprises a trimmed free end having a generally conical shape, and a scaled-up image 70*b* comprises a plurality of triangles having a first color 61*b* and a background having a second color 62*b* different from the first color 61*b*. The scaled-up images of the triangles may be designed to proportionally approximate relative dimensions of the tapered tips of the filaments used in the oral-care implement 10*b*.

Figure 19:
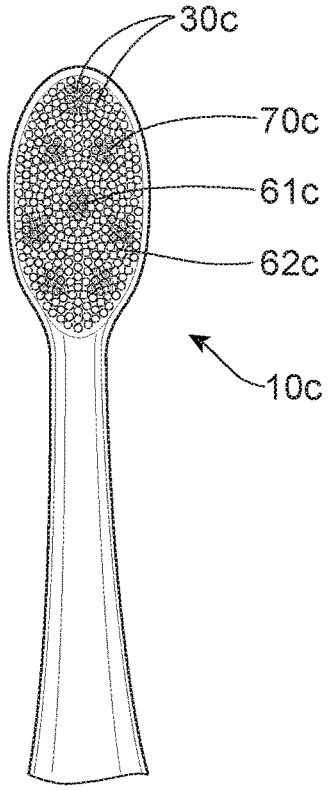
FIG. 19 schematically shows a plan view of an exemplary embodiment of an oral-care implement having a scaled-up image comprising a plurality of rectangles and representing a functional characteristic of a plurality of filaments having rectangular cross-sections.

In FIG. 19, schematically showing a fragment of a manual toothbrush comprising an oral-care implement 10*c*, the functional characteristic of at least some of the filaments comprises a rectangular cross-section of a filament 30*c*, and a scaled-up image 70*c* comprises a plurality of rectangles having a first color 61*c* and a background having a second color 62*c* different from the first color 61*b*.

Figure 20:
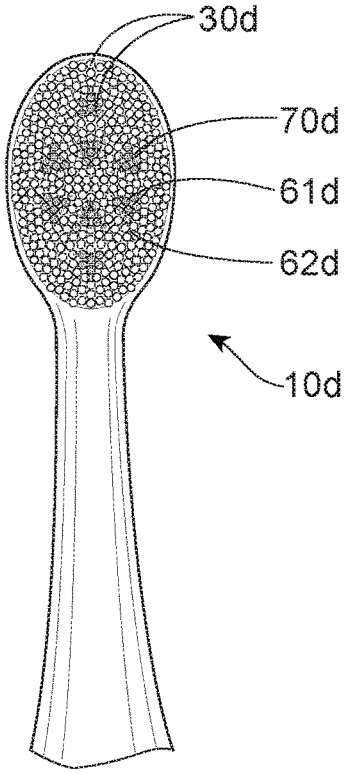
FIG. 20 schematically shows a plan view of an exemplary embodiment of an oral-care implement having a scaled-up image comprising a plurality of triangles and representing a functional characteristic of a plurality of filaments having triangular cross-sections.

In FIG. 20, schematically showing a fragment of a manual toothbrush comprising an oral-care implement 10*d*, the functional characteristic of at least some of the filaments 30*d* comprises a triangular cross-section of a filament, and a scaled-up image 70*c* comprises a plurality of triangles having a first color 61*c* and a background having a second color 62*c* different from the first color 61*b*.

Figure 21:
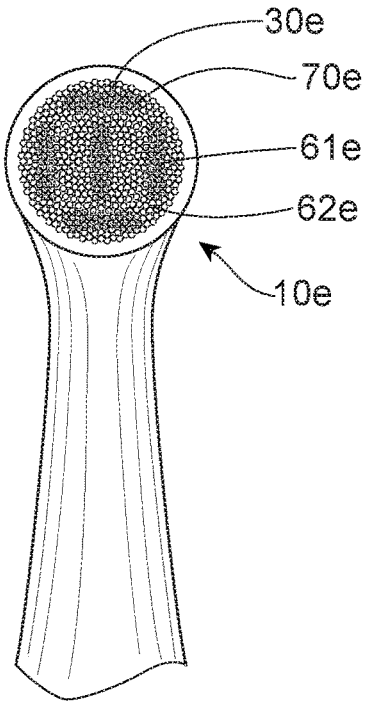
FIG. 21 schematically shows a plan view of an exemplary embodiment of an oral-care implement having a scaled-up image comprising a plurality of ellipses and representing a functional characteristic of a plurality of filaments having elliptical cross-sections.

In FIG. 21, schematically showing a fragment of a refill for an electric toothbrush comprising an oral-care implement 10*e*, the functional characteristic of at least some of the filaments comprises an elliptical, or oval cross-section of a filament 30*e*, and a scaled-up image 70*e* comprises a plurality of ellipses, or ovals, having a first color 61*e* and a background having a second color 62*e* different from the first color 61*e*.

Figure 22A:
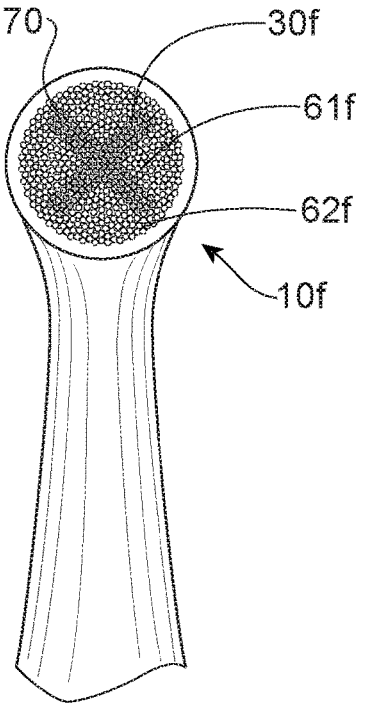
FIGS. 22A and 22B schematically show plan views of two respective exemplary embodiments of oral-care implements, each having a scaled-up image comprising an X-shaped, or cross-shaped pattern and representing a functional characteristic of a plurality of filaments having an X-shaped, or cross-shaped cross-section.

In FIG. 22A, schematically showing a fragment of a refill for an electric toothbrush comprising an oral-care implement 10*f*, the functional characteristic of at least some of the filaments 30*f* comprises an X-shaped cross-section of a filament, and a scaled-up image 70*f* comprises an X-shaped pattern having a first color 61*f* and a background having a second color 62*f* different from the first color 61*f*.

Figure 22B:
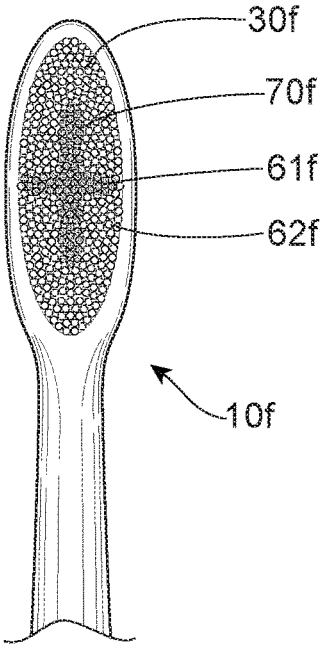

In FIG. 22B, schematically showing a fragment of a manual toothbrush comprising an oral-care implement 10F, the functional characteristic of at least some of the filaments 30F comprises a cross-shaped cross-section of a filament, and a scaled-up image 70F comprises a cross-shaped pattern having a first color 61F and a background having a second color 62F different from the first color 61F.

Figure 23:
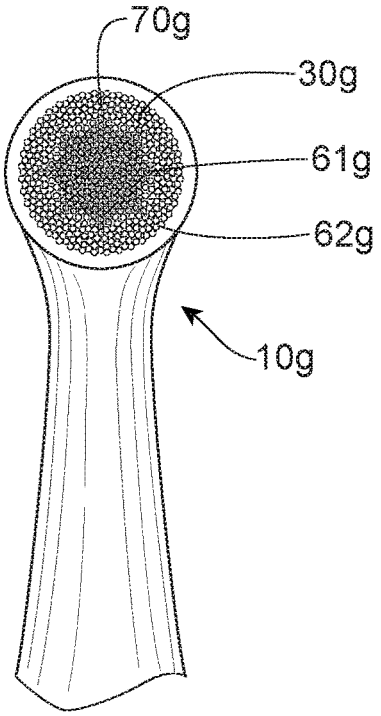
FIG. 23 schematically shows a plan view of an exemplary embodiment of an oral-care implement having a scaled-up image comprising a star-shaped pattern representing a functional characteristic of a plurality of filaments having star-shaped cross-sections.

In FIG. 23, schematically showing a fragment of a refill for an electric toothbrush comprising an oral-care implement 10*g*, the functional characteristic of at least some of the filaments 30*g* comprises a star-shaped cross-section of a filament, and a scaled-up image 70*g* comprises a star-shaped pattern having a first color 61*g* and a background having a second color 62*g* different from the first color 61F.

Figure 24:
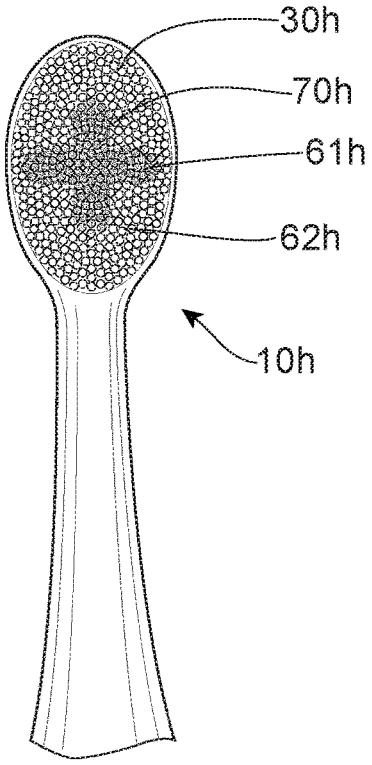
FIG. 24 schematically shows a plan view of an exemplary embodiment of an oral-care implement having a scaled-up image comprising a multi-lobal pattern representing a functional characteristic of filaments having a multi-lobal cross-section.

In FIG. 24, schematically showing a fragment of a manual toothbrush comprising an oral-care implement 10*h*, the functional characteristic of at least some of the filaments 30*h* comprises a multi-lobal cross-section of a filament, and a scaled-up image 70*h* comprises a multi-lobal pattern having a first color 61*h* and a background having a second color 62*h* different from the first color 61F.

Figure 25A:
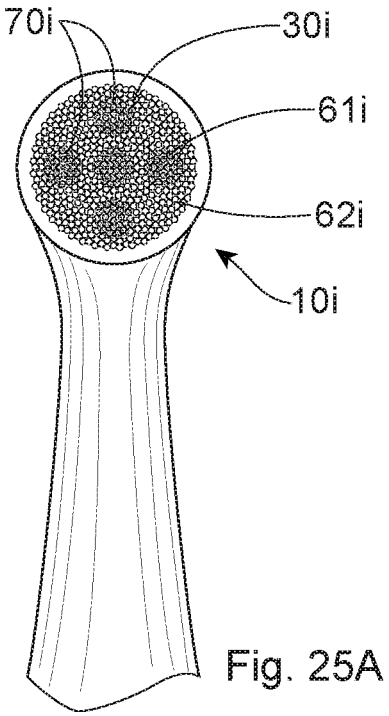
FIG. 25A schematically shows a plan view of an exemplary embodiment of an oral-care implement having a scaled-up image comprising a plurality of discrete areas representing a functional characteristic of a plurality of filaments having tip surfaces that include pluralities of discrete islands disposed thereon.

In FIG. 25A, schematically showing a fragment of a refill for an electric toothbrush comprising an oral-care implement 10*i*, the functional characteristic of at least some of the filaments 30*i* comprises a tip surfaces that include a plurality of discrete islands disposed thereon, and a scaled-up image 70*i* comprises a plurality of discrete areas having a first color 61*i* and a background having a second color 62*i* different from the first color 61*i*. As is explained herein above, with reference to FIGS. 11 and 12, the islands may comprise depressions and/or protrusions. Also, the islands may have any suitable cross-section other than a circular one, shown in FIGS. 11 and 12. The scaled-up image 70*i* may be designed to reflect the number of the island and their shape(s).

Figure 25B:
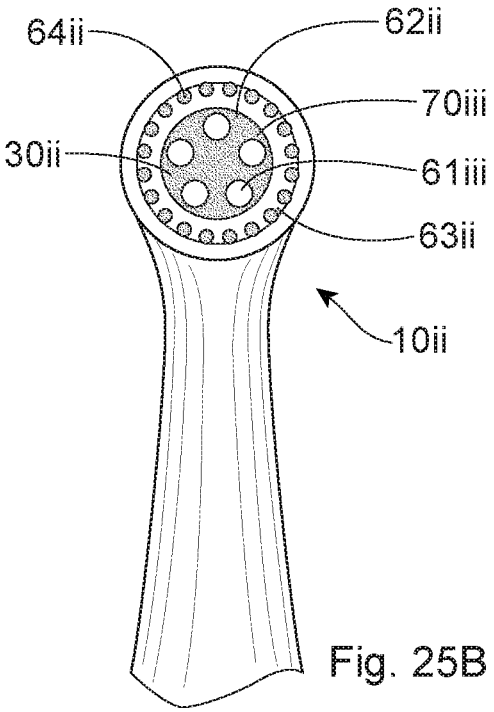
FIG. 25B schematically shows a plan view of an exemplary embodiment of an oral-care implement having a scaled-up image including three colors and comprising a plurality of discrete areas representing a functional characteristic of a plurality of filaments having tip surfaces that include pluralities of discrete islands disposed thereon.

FIG. 25B schematically shows another exemplary embodiment of a refill for an electric toothbrush wherein the functional characteristic of at least some of the filaments 30*ii* comprises a tip surfaces that include a plurality of discrete islands. In an oral-care implement 10*ii*, a scaled-up image 70*ii* comprises a plurality of discrete areas having a first color 61*ii* and a background having a second color 62*ii* different from the first color 61*ii*. The second color 62*ii* forms a background for the first color 61*ii*. In FIG. 25B, the second color 62*ii* is shown as comprising a generally circular shape, but it should be understood that any other suitable shape, e.g., a rectangular or elliptical shape, can be used, depending, e.g., on the cross-sectional shape of the filament. A third color 63*ii* can also be used, e.g., as a background for other scaled-up images, e.g., 64*ii*. All shapes or images comprising colors 61*ii*, 62*ii*, 63*ii*, 64*ii* may be different from one another. Alternatively, some shapes or images that do not directly border each other may have identical or similar colors. For example, the first color 61*ii* and the third color 63*ii* may be identical or similar. Likewise, the second color 62*ii* and the fourth color 64*ii* may be identical or similar.

Figure 26:
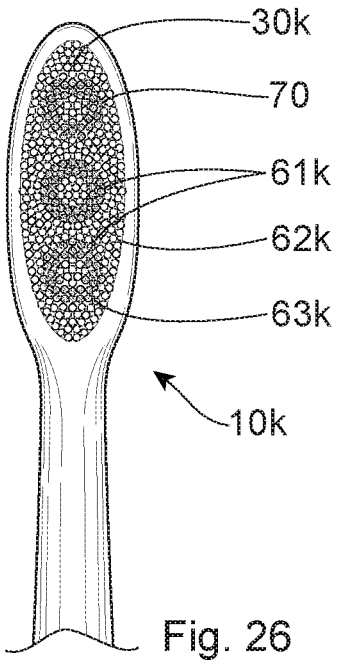
FIG. 26 schematically shows a plan view of an exemplary embodiment of an oral-care implement having a scaled-up image comprising a plurality of rings and representing a functional characteristic of a plurality of bi-component filaments comprising a first material encompassed by a second material.

In FIG. 26, schematically showing a fragment of a manual toothbrush comprising an oral-care implement 10*k*, the functional characteristic of at least some of the filaments 30*k* comprises their bi-component structure including a first material encompassed by a second material, and a scaled-up image 70*k* comprises a plurality of rings having a first color 61*k* and a background having a second color 62*k* different from the first color 61*k*. Discrete areas that are circumferentially encompassed by the rings may have the color identical to the second color 62*k*. Alternatively, the discrete areas circumferentially encompassed by the rings may have a third color 63*k*, different from both the first color 61*k* and the second color 62*k*.

The oral-care implement 10 may have more than one plurality of filaments 30. In FIG. 24, for example, the oral-care implement 10 comprises a first plurality of filaments 30*h* and a second plurality of filaments 30H different from the first plurality of filaments 30*h* with respect to at least one functional characteristic selected from the group consisting of filament's structure, composition, cross-sectional shape, tip geometry, and any combination thereof. In one such embodiment, the first plurality of filaments 30*h* comprises the first color 61*h* and the second plurality of filaments 30H comprises the second color 62*h*, FIG. 24. Thus, the first plurality of filaments and the second plurality of filaments may differ from one another with respect to both the functional characteristic and the color.

Figure 27:
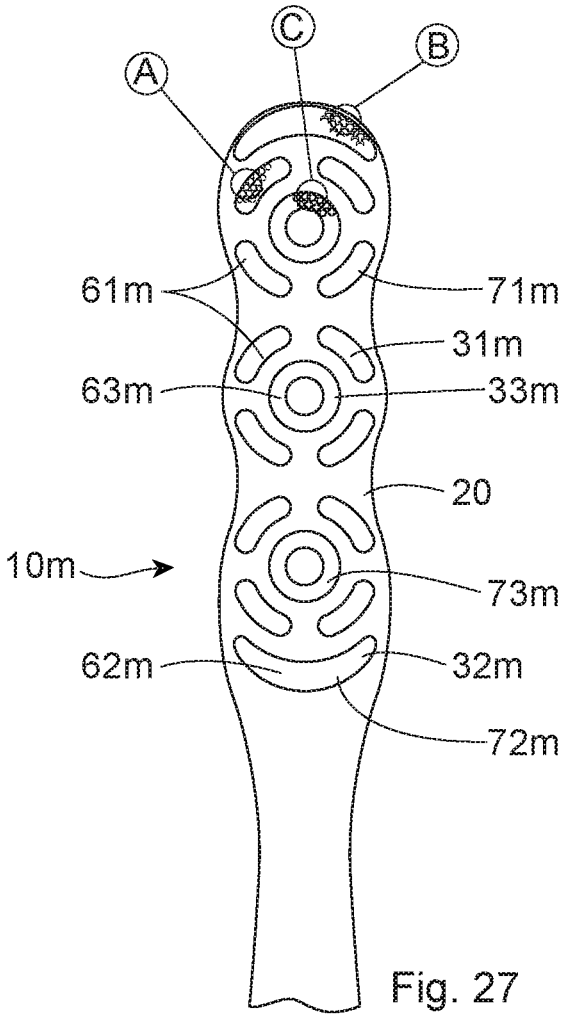
FIG. 27 schematically shows a plan view of an exemplary embodiment of an oral-care implement having a first scaled-up image, a second scaled-up image different from the first scaled-up image, and a third scaled-up image different from the first and second scaled-up images.
Figure 27A:
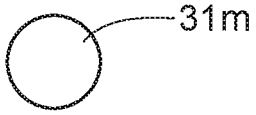
FIG. 27A schematically shows an enlarged plan view of a cross-section of an individual filament of a first plurality of filaments of FIG. 27, indicated by letter "A" therein.
Figure 27B:
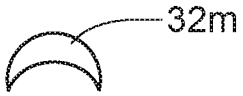
FIG. 27B schematically shows an enlarged plan view of a cross-section of an individual filament of a second plurality of filaments of FIG. 27, indicated by letter "B" therein.
Figure 27C:
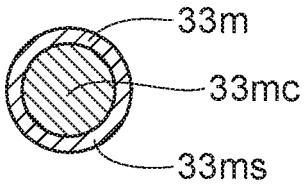
FIG. 27C schematically shows an enlarged plan view of a cross-section of an individual filament of a third plurality of filaments of FIG. 27, indicated by letter "C" therein.

In a further exemplary embodiment, schematically illustrated in FIG. 27, the oral-care implement 10*m* comprises at least three pluralities of filaments: a first plurality of filaments 31*m*, a second plurality of filaments 32*m*, and a third plurality of filaments 33*m*. The three pluralities of filaments 31*m*, 32*m*, and 33*m* differ from one another with respect to at least one functional characteristic selected from the group consisting of filament's structure, composition, cross-sectional shape, tip geometry, and any combination thereof. For example, the first plurality of filaments 31*m* may comprise filaments having a generally cylindrical shape with a cross-section of a circle (FIG. 27A); the second plurality of filaments 32*m* may comprise filaments having cross-sections of a generally crescent shape; (FIG. 27B) and the third plurality of filaments 33*m* may comprise composite filaments having a bi-component structure comprising a core material 33*mc* encased by a sheath material $\mathbf{33}_{ms}$ (FIG. 27C). One skilled in the art will understand that the embodiment of FIG. 27 may comprise additional pluralities of filaments or tufts of filaments (not shown), disposed among or around the filaments 31*m*, 32*m*, 33*m*. These additional filaments may be colored to provide a background color—or to otherwise contrast one or more of the three pluralities of filaments 31*m*, 32*m*, 33*m*.

In the exemplary embodiment shown in FIG. 27, there are three scaled-up images: a first image 71*m*, a second image 72*m*, and a third image 73*m*. The first image 71*m* comprises four similarly curved lines and having the first color 61*m*. Because the four curved lines are positioned in a general shape of a circle and have identical color, consumers will perceive these four curved lines in combination as a single unit comprising a circle or a ring. In other words, the four identically curved lines having identical color will impart an image 71*m* of a circle or a ring. The second image 72*m* comprises two oppositely positioned crescents having the second color 62*m*. The third image 73*m* comprises a ring having a third color 63*m*.

In the exemplary embodiment of FIG. 27, the first image 71*m* is formed by the first plurality of filaments 31*m*, the second image 72*m* is formed by the second plurality of filaments 32*m*, and the third image 73*m* is formed by the third plurality of filaments 33*m*. Such an arrangement of the filaments results in each plurality of filaments forming, in plan view, its own shape, comprising a scaled-up image of the functional characteristic specific for the individual plurality of filaments. But it should be understood that the three images 71*m*, 72*m*, 73*m* may be formed by any of the three pluralities of filaments 31*m*, 32*m*, 33*m* in any suitable way. In other words, any of the images 71*m*, 72*m*, 73*m* may be formed by filaments selected from the group consisting of the first plurality of filaments 31*m*, the second plurality of filaments 32*m*, the third plurality of filaments 33*m*, and any combination thereof.

If, for example, the oral-care implement comprises a first plurality of cylindrical filaments, a second plurality of rectangular filaments, and a third plurality of X-shaped filaments, the scaled-up X-shaped image may be formed by (a) the cylindrical filaments, (b) the rectangular filaments, and (c) the X-shaped filaments, or any combination thereof. Likewise, the scaled-up rectangular image may be formed by (a) the cylindrical filaments, (b) the rectangular filaments, and (c) the X-shaped filaments, or any combination thereof. Of course, an embodiment is contemplated in which the scaled-up X-shaped image is formed only by the X-shaped filaments, and the scaled-up rectangular image is formed by only the rectangular filaments.

In some embodiments, any of the pluralities of filaments may comprise an individual tuft or a plurality of tufts. In the exemplary embodiment of FIG. 27, for example, any of the first, second, and third pluralities of filaments 31*m*, 32*m*, 33*m* may comprise an individual tuft or a plurality of tufts. These pluralities of tufts can be arranged to comprise, in a plan view, a shape of a scaled-up image of the cross-sectional area of those filaments that comprise the thus arranged pluralities of tufts. The disclosure of a commonly assigned application CM04051FQ, EP14158836.8, is incorporated herein by reference. In the embodiment of FIG. 27, the first plurality of filaments 31*m* comprises a first plurality of tufts, the second plurality of filaments 32*m* comprises a second plurality of tufts, and the third plurality of filaments 33*m* comprises a third plurality of tufts. The first, second, and third pluralities of tufts can be colored to comprise scaled-up images as described herein.

Embodiments are contemplated in which any of the pluralities of filaments may comprise any tuft or plurality of tufts. If, for example, the oral-care implement comprises a first plurality of cylindrical filaments, a second plurality of rectangular filaments, and a third plurality of X-shaped filaments, an X-shaped tuft or plurality of tufts may be formed by (a) the cylindrical filaments, (b) the rectangular filaments, and (c) the X-shaped filaments, or any combination thereof. Likewise, a rectangular tuft or plurality of tufts may be formed by (a) the cylindrical filaments, (b) the rectangular filaments, and (c) the X-shaped filaments, or any combination thereof. Of course, an embodiment is contemplated in which the X-shaped tuft or plurality of tufts is formed only by the X-shaped filaments, and the rectangular tuft or plurality of tufts is formed by only the rectangular filaments. Regardless of whether or not the shape of any of the first, second, and third tuft or plurality of tufts has a scaled-up shape of the filaments forming that tuft or plurality of tufts, any of the first, second, and third tufts or plurality of tufts can be colored to comprise a scaled-up image or scaled-up images as described herein.

Figure 28A:
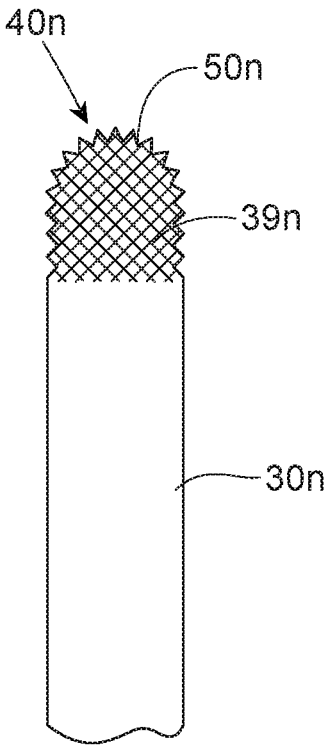
FIG. 28A schematically shows an enlarged side view of an exemplary filament having a rounded free end, wherein a portion of the filament's surface, including the filaments round end and an area adjacent thereto, is textured or roughened.
Figure 28B:
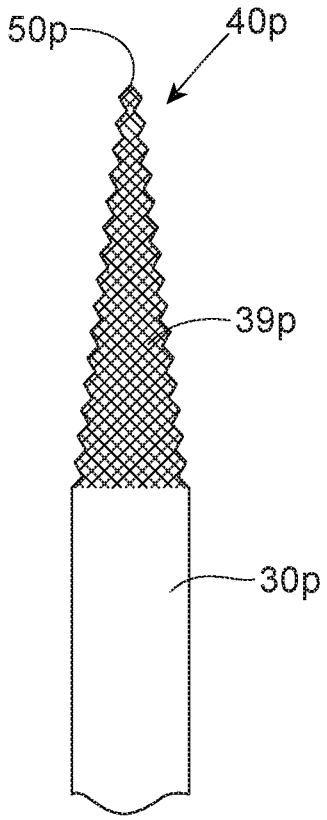
FIG. 28B schematically shows an enlarged side view of an exemplary filament having a tapered free end, wherein a portion of the filament's surface, including the filament's tapered end is textured or roughened.

In further exemplary embodiments of the oral-care implement 10, schematically illustrated in FIGS. 28A and 28B, the functional characteristic comprises textured or roughened area of the filament's surface. FIG. 28A shows a textured area 39*n* of a portion of the surface of a filament 30*n*, e.g., the filament's tip 50*n* and a portion of the filament's surface including the filament's rounded free end 40*n* and an area adjacent thereto. FIG. 28B shows, likewise, a textured area 39*p* of a portion of the surface of a filament 30*p*, including the filament's tip 50*p* and a portion of the filament's surface including the filament's tapered free end 40*p* and an area adjacent thereto. During brushing, the filaments comprising textured or roughened portions can provide additional benefits, due to an increased surface area and enhanced abrasion imparted by the textured area on the teeth surface. This can facilitate removal of dental plaque and/or stain. In addition, surface irregularities and tiny voids in the textured surface can also entrap and remove microscopic food particles and other contaminants from the surface of teeth.

Figure 29:
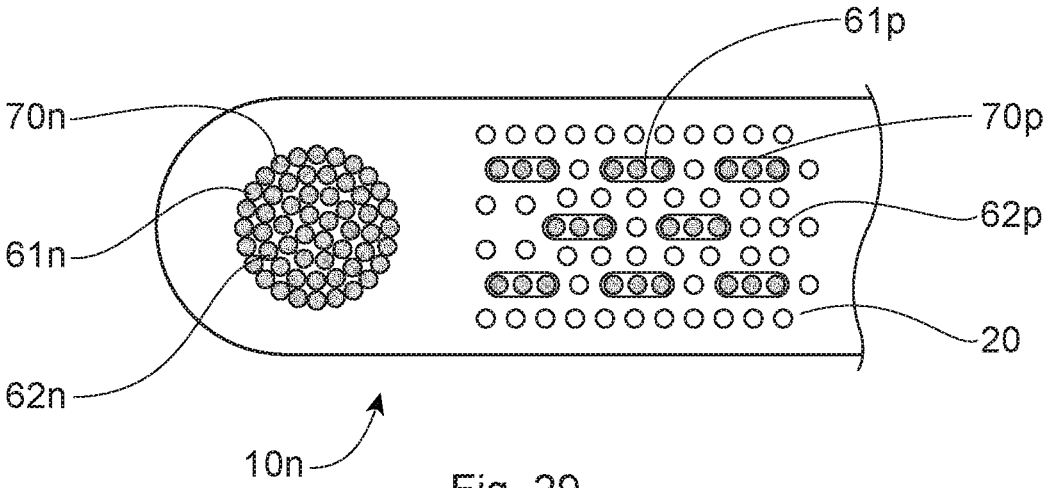
FIG. 29 schematically shows a plan view of an exemplary embodiment of an oral-care implement having an image comprising dotted lines and an image comprising a plurality of dashed lines, each of the images representing a functional characteristic of filaments having a roughened or textured area of at least a portion of the filament's surface.

In FIG. 29, schematically shows a fragment of an oral-care implement 10*n* wherein the filaments' functional characteristic comprises a textured or roughened area. Two exemplary scaled-up images 70*n* and 70*p* comprise, respectively, dotted lines (70*n*) having a first color 61*n*, and broken or dashed lines (70*p*) having a first color 61*p*. A background has a second color 62*n* different from the first color 61*n*.

In further embodiments of the oral-care implement 10, one of the colors can be designed to change with the passage of time—to indicated to a user an extent to which the filaments are worn—and eventually that the oral-care implement needs to be replaced with a new one. This can be done using a variety of methods. For example, the first color may comprise a color-changing material that would causes the first color to gradually change—to eventually match the second color after a predetermined period of use of the oral-care implement. The disclosure of U.S. Pat. No. 5,313,909, directed to wear-indicating filaments, is incorporated by reference herein.

In another embodiment, the first color may be structured to slowly wear away during the use of the oral-care implement. If the first color covers a portion or portions of the second color, the incremental wearing away of the first color would be incrementally exposing the second color covered by the first color. This, too, would indicate to a user an extent to which the filaments are worn. Eventually the first color will substantially wear away after a predetermined period of use of the oral-care implement, and that scaled-up image graphically replicating the functional characteristic will be noticeably altered or altogether erased. This will indicate to a user that the oral-care implement needs to be replaced.

Figure 30A:
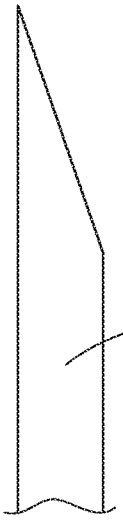
FIG. 30A schematically shows an enlarged side view of an exemplary filament having a functional characteristic comprising a trimmed tip.
Figure 30B:
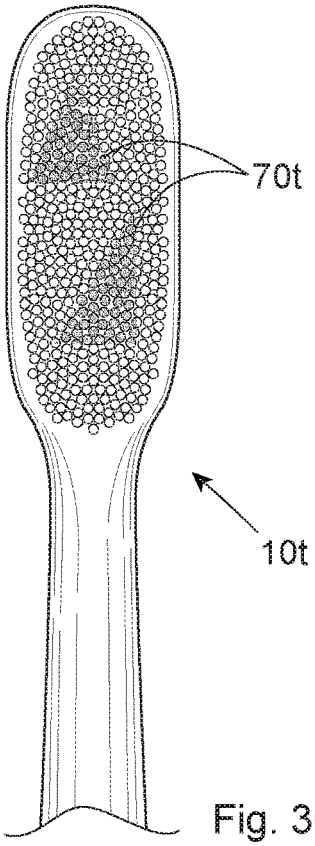
FIG. 30B schematically shows a plan view of an exemplary embodiment of an oral-care implement having a scaled-up image comprising a plurality of triangles representing the functional characteristic of the filament shown in FIG. 30A.
Figure 31A:
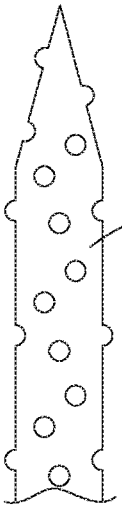
FIG. 31A schematically shows an enlarged side view of an exemplary filament having a functional characteristic comprising surface irregularities formed by microscopic protrusions and depressions.
Figure 31B:
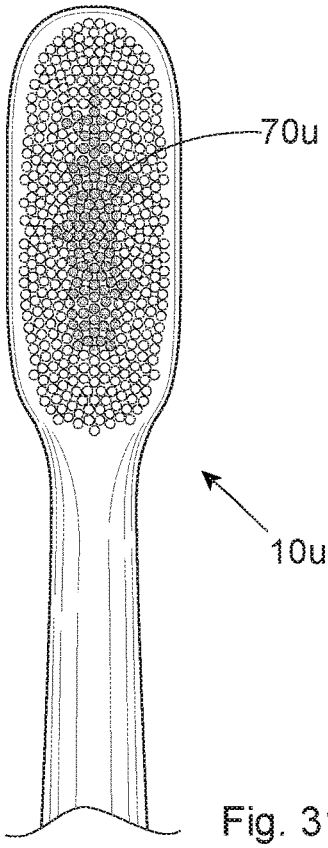
FIG. 31B schematically shows a plan view of an exemplary embodiment of an oral-care implement having a scaled-up image representing the functional characteristic of the filament shown in FIG. 31A.
Figure 32A:
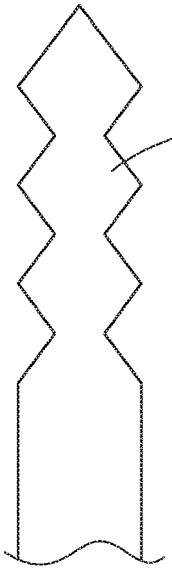
FIG. 32A schematically shows an enlarged side view of an exemplary filament having a functional characteristic comprising side surface formed by profiled circular grooves.
Figure 32B:
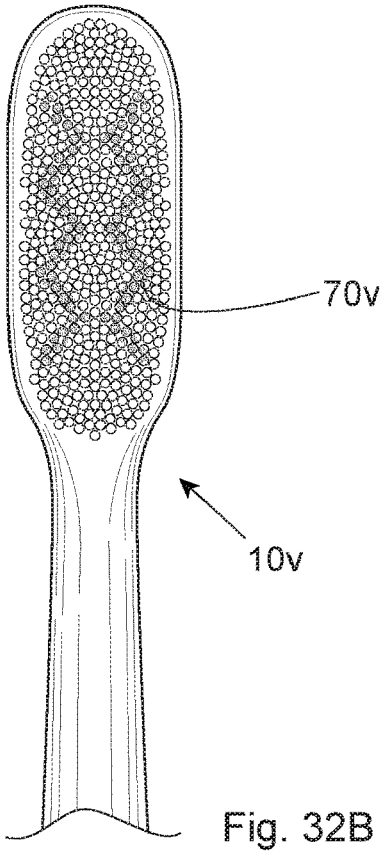
FIG. 32B schematically shows a plan view of an exemplary embodiment of an oral-care implement having a scaled-up image representing the functional characteristic of the filament shown in FIG. 32A.
Figure 33A:
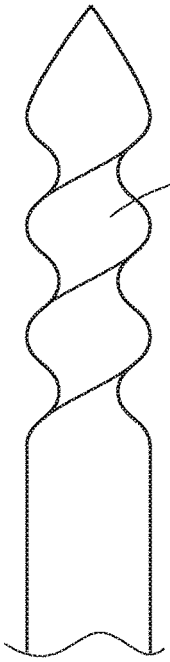
FIG. 33A schematically shows an enlarged side view of an exemplary filament having a functional characteristic comprising the filament's differential-diameter.
Figure 33B:
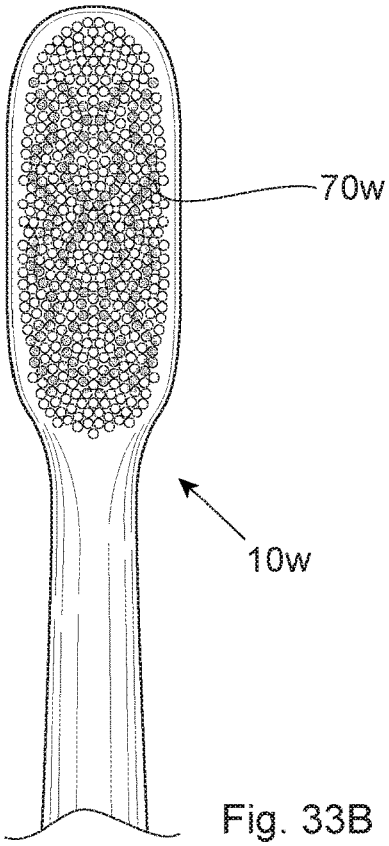
FIG. 33B schematically shows a plan view of an exemplary embodiment of an oral-care implement having a scaled-up image representing the functional characteristic of the filament shown in FIG. 33A.

One skilled in the art should realize that many more embodiments encompassing the claimed invention can be constructed based on the principles of the present disclosure. For example, an oral-care implement 10*t* may have a scaled-up image 70*t* comprising a plurality of triangles representing the functional characteristic of a filament 30*t* having a trimmed tip, as is shown in FIGS. 30A and 30B. In another embodiment, an oral-care implement 10*u* may have a scaled-up image 70*u* comprising a side-view profile of a filament 30*u* having a functional characteristic comprising surface irregularities formed by microscopic protrusions and depressions, as is shown in FIGS. 31A and 31B. In further embodiments, an oral-care implement 10*v* may have a scaled-up image 70*v* comprising one or more waving and/or zigzag lines representing a filament 30*v* having a functional characteristic comprising side surface and/or longitudinal cross-section formed by profiled circular grooves, as is schematically shown in FIGS. 32A and 32B. An oral-care implement 10*w* may have a scaled-up image 70*w* comprising one or more alternating lines representing a filament 30*w* having a functional characteristic comprising a filament's spiral configuration and/or a filament's differential-diameter, as is schematically shown in FIGS. 33A and 33B. Like the embodiments previously described, these are non-exclusive, non-limiting examples of the oral-care implement of the invention.

Some of the filaments may include an antimicrobial agent. The U.S. Pat. No. 5,906,834, the disclosure of which is incorporated herein by reference, describes an antimicrobial agent comprising chlorhexidine digluconate, which is well-known for its gingivitis-prevention properties. The amount of chlorhexidine included may depend, among other things, on the level of the desired dosage, and may comprise between 1 percent and 30 percent of chlorhexidine digluconate by weight.

While particular embodiments have been illustrated and described herein, various other changes and modifications may be made without departing from the spirit and scope of the invention. Moreover, although various aspects of the invention have been described herein, such aspects need not be utilized in combination. It is therefore intended to cover in the appended claims all such changes and modifications that are within the scope of the invention.

The terms "substantially," "essentially," "about," "approximately," and the like, as may be used herein, represent the inherent degree of uncertainty that may be attributed to any quantitative comparison, value, measurement, or other representation. These terms also represent the degree by which a quantitative representation may vary from a stated reference without resulting in a change in the basic function of the subject matter at issue. Further, the dimensions and values disclosed herein are not to be understood as being strictly limited to the exact numerical values recited. Instead, unless otherwise specified, each such dimension is intended to mean both the recited value and a functionally equivalent range surrounding that value. For example, values disclosed as "0.1 mm" or "90 degrees" are intended to mean, respectively, "about 0.1 mm" or "about 90 degrees."

The disclosure of every document cited herein, including any cross-referenced or related patent or application, and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein—or that it alone, or in any combination with any other reference or references, teaches, suggests, or discloses any such invention. Further, to the extent that any meaning or definition of a term in this document conflicts with any meaning or definition of the same or similar term in a document incorporated by reference, the meaning or definition assigned to or contextually implied by that term in this document shall govern.

We claim:

1. An oral-care implement comprising:

a mounting surface having a longitudinal axis and a transverse axis perpendicular to the longitudinal axis;

a plurality of filaments outwardly extending from the mounting surface in at least one direction not parallel to either one of the longitudinal and transverse axes, each filament having a free end terminating with a filament tip, a plurality of the filament tips forming an overall working surface;

wherein at least some of the filaments possess at least one functional characteristic selected from the group consisting of filament's structure, composition, cross-sectional shape, tip geometry, and any combination thereof;

wherein the overall working surface comprises at least a first color and a second color different from the first color;

wherein the at least first and second colors form, in combination, at least one scaled-up image disposed on the overall working surface and graphically replicating the at least one functional characteristic, thereby visually communicating to a consumer that the oral-care implement includes filaments having said at least one functional characteristic, wherein the at least one functional characteristic comprises an X-shaped or cross-shaped cross-section of a filament, and the at least one scaled-up image has a shape of an X-shaped or cross-shaped area having the first color, wherein the working surface comprises a background having a second color.

2. The oral-care implement of claim 1, wherein the background further includes a third color different from the first color and the second color.

3. The oral-care implement of claim 1, wherein the plurality of filaments comprises at least a first plurality of filaments and a second plurality of filaments, the first plurality of filaments having a first functional characteristic selected from the group consisting of filament's structure, composition, cross-sectional shape, tip geometry, and any combination thereof, and the second plurality of filaments having a second functional characteristic selected from the group consisting of filament's structure, composition, cross-sectional shape, tip geometry, and any combination thereof, the first functional characteristic being different from the second functional characteristic.

4. The oral-care implement of claim 3, wherein the first plurality of filaments comprises the first color and the second plurality of filaments comprises the second color.

5. The oral-care implement of claim 3, wherein the plurality of filaments comprises at least a third plurality of filaments having a third functional characteristic selected from the group consisting of filament's structure, composition, cross-sectional shape, tip geometry, and any combination thereof, the third functional characteristic being different from the first functional characteristic and the second functional characteristic.

6. The oral-care implement of claim 3, wherein at least one of the first plurality of filaments and the second plurality of filaments comprises composite, multi-component filaments.

7. The oral-care implement of claim 6, wherein the filaments comprising composite, multi-component filaments include a first material forming a core and a second material forming a sheath.

8. The oral-care implement of claim 1, wherein the first color comprises a color-changing material that causes the first color to gradually change to eventually match the second color after a predetermined period of use of the oral-care implement.

9. The oral-care implement of claim 1, wherein the first color at least partially covers the second color, and wherein the first color is structured to slowly wear away during the use of the oral-care implement to indicate an extent to which the filaments are worn.

10. The oral-care implement of claim 9, wherein the first color is structured to substantially wear away after a predetermined period of use of the oral-care implement so that the at least one scaled-up image is noticeably altered by an end of said predetermined period of use.

11. The oral-care implement of claim 1, wherein the at least some of the filaments are arranged in at least one tuft having a shape comprising the at least one scaled-up image graphically replicating the at least one functional characteristic of the at least some of the filaments.

12. The oral-care implement of claim 1, wherein the at least one functional characteristic of the at least some of the filaments comprises a non-circular cross-sectional shape.

13. The oral-care implement of claim 1, wherein the overall working surface comprises a convex portion.

14. The oral-care implement of claim 1, wherein the overall working surface comprises a concave portion.

15. The oral-care implement of claim 1, wherein the at least one scaled-up image graphically replicating the at least one functional characteristic visually communicates to a consumer that the oral-care implement possesses a superior efficacy attributable to said filaments having the at least one functional characteristic.

16. A manual toothbrush comprising the oral-care implement of claim 1.

17. A refill for an electric toothbrush, the refill comprising the oral-care implement of claim 1.

18. An electric toothbrush comprising the oral-care implement of claim 1.

* * * * *